US011602479B2

(12) United States Patent
Moore

(10) Patent No.: US 11,602,479 B2
(45) Date of Patent: Mar. 14, 2023

(54) SYSTEMS AND METHODS FOR PROVIDING SYNCHRONIZED MOVEMENTS OF A POWERED WHEELCHAIR AND AN EXOSKELETON

(71) Applicant: Toyota Motor Engineering & Manufacturing North America, Inc., Plano, TX (US)

(72) Inventor: Douglas A. Moore, Fairview, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 1051 days.

(21) Appl. No.: 15/920,763

(22) Filed: Mar. 14, 2018

(65) Prior Publication Data

US 2019/0282431 A1 Sep. 19, 2019

(51) Int. Cl.

| | |
|---|---|
| ***A61H 3/04*** | (2006.01) |
| ***A61G 5/04*** | (2013.01) |
| ***A61G 5/14*** | (2006.01) |
| ***A61H 1/02*** | (2006.01) |
| ***A61H 3/00*** | (2006.01) |

(52) U.S. Cl.

CPC ..... *A61H 3/04* (2013.01); *A61G 5/04* (2013.01); *A61G 5/14* (2013.01); *A61H 1/0237* (2013.01);

(Continued)

(58) Field of Classification Search

CPC ..... A61G 5/04; A61G 5/14; A61H 1/0237; A61H 1/0255; A61H 3/04;

(Continued)

(56) References Cited

U.S. PATENT DOCUMENTS 3,769,636 A 11/1973 Friedman
3,967,321 A 7/1976 Ryan et al.

(Continued)

FOREIGN PATENT DOCUMENTS

CN 106510985 A 3/2017
EP 3141231 A2 3/2017

(Continued)

OTHER PUBLICATIONS

Extended European Search Report dated Aug. 9, 2019 in European Patent Appln. No. 19162943.5.

(Continued)

*Primary Examiner* — Justine R Yu
*Assistant Examiner* — Alexander Morales
(74) *Attorney, Agent, or Firm* — Dinsmore & Shohl LLP

(57) ABSTRACT

Embodiments herein are directed to a system that includes a powered wheelchair, a user-worn exoskeleton, and a master controller. The master controller monitors the independent movements of the powered wheelchair and the user-worn exoskeleton. The master controller prioritizes the movement of the powered wheelchair and the user-worn exoskeleton such that only one of the powered wheelchair or the user-worn exoskeleton will have the priority to complete the intended movement. The master controller may coordinate movements between the powered wheelchair and the user-worn exoskeleton so to perform a plurality of predetermined programs. For example, assisting a user to sit within the powered wheelchair, to assist a user to stand from a seating position when outside of the powered wheelchair, and/or use the powered wheelchair as a guide for walking.

20 Claims, 10 Drawing Sheets

(52) U.S. Cl.
CPC ..... *A61H 1/0255* (2013.01); *A61H 2003/006* (2013.01); *A61H 2003/043* (2013.01); *A61H 2003/046* (2013.01); *A61H 2201/165* (2013.01); *A61H 2201/1633* (2013.01); *A61H 2201/5007* (2013.01); *A61H 2201/5012* (2013.01); *A61H 2201/5025* (2013.01); *A61H 2201/5048* (2013.01); *A61H 2201/5064* (2013.01); *A61H 2201/5092* (2013.01); *A61H 2201/5097* (2013.01); *A61H 2203/0406* (2013.01); *A61H 2203/0431* (2013.01)

(58) Field of Classification Search
CPC ..... A61H 2003/006; A61H 2003/043; A61H 2003/046; A61H 2201/1633; A61H 2201/165; A61H 2201/5007; A61H 2201/5012; A61H 2201/5025; A61H 2201/5048; A61H 2201/5064; A61H 2201/5092; A61H 2205/509; A61H 2203/0406; A61H 2203/0431; A61H 3/00; B25J 9/0006
See application file for complete search history.

(56) References Cited

U.S. PATENT DOCUMENTS 6,462,656 B2 * 10/2002 Ulrich ..... G06K 17/0022 340/539.1
7,396,337 B2 7/2008 McBean et al.
2006/0149338 A1 * 7/2006 Flaherty ..... A61H 1/0277 607/49
2007/0270723 A1 * 11/2007 Krebs ..... A61H 3/00 601/5
2011/0201978 A1 8/2011 Jeon et al.
2013/0158445 A1 * 6/2013 Kazerooni ..... A61H 3/00 601/35
2013/0253291 A1 * 9/2013 Dixon ..... A61B 5/14551 600/323
2014/0257560 A1 * 9/2014 Kamara ..... A61F 2/72 700/250
2016/0346156 A1 * 12/2016 Walsh ..... A63B 21/152
2017/0071812 A1 3/2017 Sandler et al.
2018/0056985 A1 * 3/2018 Coulter ..... B60K 7/0007
2018/0214328 A1 * 8/2018 Cheek ..... A61G 7/1065
2018/0235832 A1 * 8/2018 Yamada ..... A61H 3/008
2018/0296426 A1 * 10/2018 Kappel ..... A61H 3/02
2019/0049977 A1 * 2/2019 Dean ..... A61H 3/00 601/5

FOREIGN PATENT DOCUMENTS

WO 2014067015 A1 5/2014
WO 2016168463 A1 10/2016

OTHER PUBLICATIONS

Communication Pursuant to Article 94(3) EPC pertaining to European Patent Application No. 19162943.5, dated Jul. 8, 2020.

* cited by examiner

SYSTEMS AND METHODS FOR PROVIDING SYNCHRONIZED MOVEMENTS OF A POWERED WHEELCHAIR AND AN EXOSKELETON

TECHNICAL FIELD

The present disclosure generally relates to control systems and, more specifically, to control systems having a master controller that coordinates motor and/or actuator controls between a powered wheelchair and an exoskeleton.

BACKGROUND

Certain users of a powered wheelchair may also be users of an independent exoskeleton that facilitates movement for the user. Typically, the user may wear the exoskeleton while in and/or near the powered wheelchair. However, because the powered wheelchair and the exoskeleton operate independently of one another, there may be a conflict when the powered wheelchair and the exoskeleton are provided with conflicting commands. Furthermore, because the powered wheelchair and the exoskeleton operate independently, the powered wheelchair and the exoskeleton may not have synchronized movements.

SUMMARY

In one embodiment, a system includes a powered wheelchair, a user-worn exoskeleton independently operable from the powered wheelchair, and a master controller. The powered wheelchair and the user-worn exoskeleton are communicatively coupled to the master controller. The master controller coordinates a plurality of synchronized movements between the powered wheelchair and the user-worn exoskeleton.

In another embodiment, a method of controlling a powered wheelchair and a user-worn exoskeleton independently operable from the powered wheelchair is provided. The method includes the step of receiving, by a master controller, an input from a user in which the input corresponds to a particular function. The master controller obtains a first data corresponding to at least one of a positioning, a movement, or an intended movement of the user-worn exoskeleton. The master controller obtains a second data corresponding to at least one of a positioning, a movement, or an intended movement of the obtained from the powered wheelchair. The processing device causes the powered wheelchair and the user-worn exoskeleton to move in a coordinated fashion based on the first data and the second data.

In yet another example, a system that has a master controller, at least one motor, and at least one actuator is provided. The at least one actuator is independent from the at least one motor. The master controller controls the movement of the at least one motor and the at least one actuator so to permit either the at least one motor or the at least one actuator to move between a first position and a second position.

These and additional objects and advantages provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The systems and methods described herein generally relate to a powered wheelchair, a user-worn exoskeleton independently operable from the powered wheelchair, and a master controller that is capable of controlling the powered wheelchair and the user-worn exoskeleton such that the powered wheelchair and the user-worn exoskeleton can be operated together by the master controller. The systems described herein are configured such that the powered wheelchair and the user-worn exoskeleton are communicatively coupled to the master controller. When concurrent control of the powered wheelchair and the exoskeleton is warranted, the master controller acts as a master controller that controls movement of the powered wheelchair and the user-worn exoskeleton such that the powered wheelchair and the user-worn exoskeleton each act as a slave device. As a result, the master controller prevents movement conflicts between the powered wheelchair and the user-worn exoskeleton and/or coordinates a plurality of synchronized movements between the powered wheelchair and the user-worn exoskeleton.

As described in further detail herein, an example of synchronized movements may include coordinating the user-worn exoskeleton with the powered wheelchair such that the powered wheelchair acts as a guide for a user holding onto the rear of the powered wheelchair while walking and while being assisted by the user-worn exoskeleton. Another example of synchronized movements may include coordinating the user-worn exoskeleton with the powered wheelchair such that a seat portion of the powered wheelchair rises to assist the exoskeleton in helping the user sit into the powered wheelchair. Yet another example of synchronized movements may include coordinating the user-worn exoskeleton with the powered wheelchair such that the powered wheelchair and the exoskeleton assist the user to stand from a sitting position in the powered wheelchair.

Figure 1A:
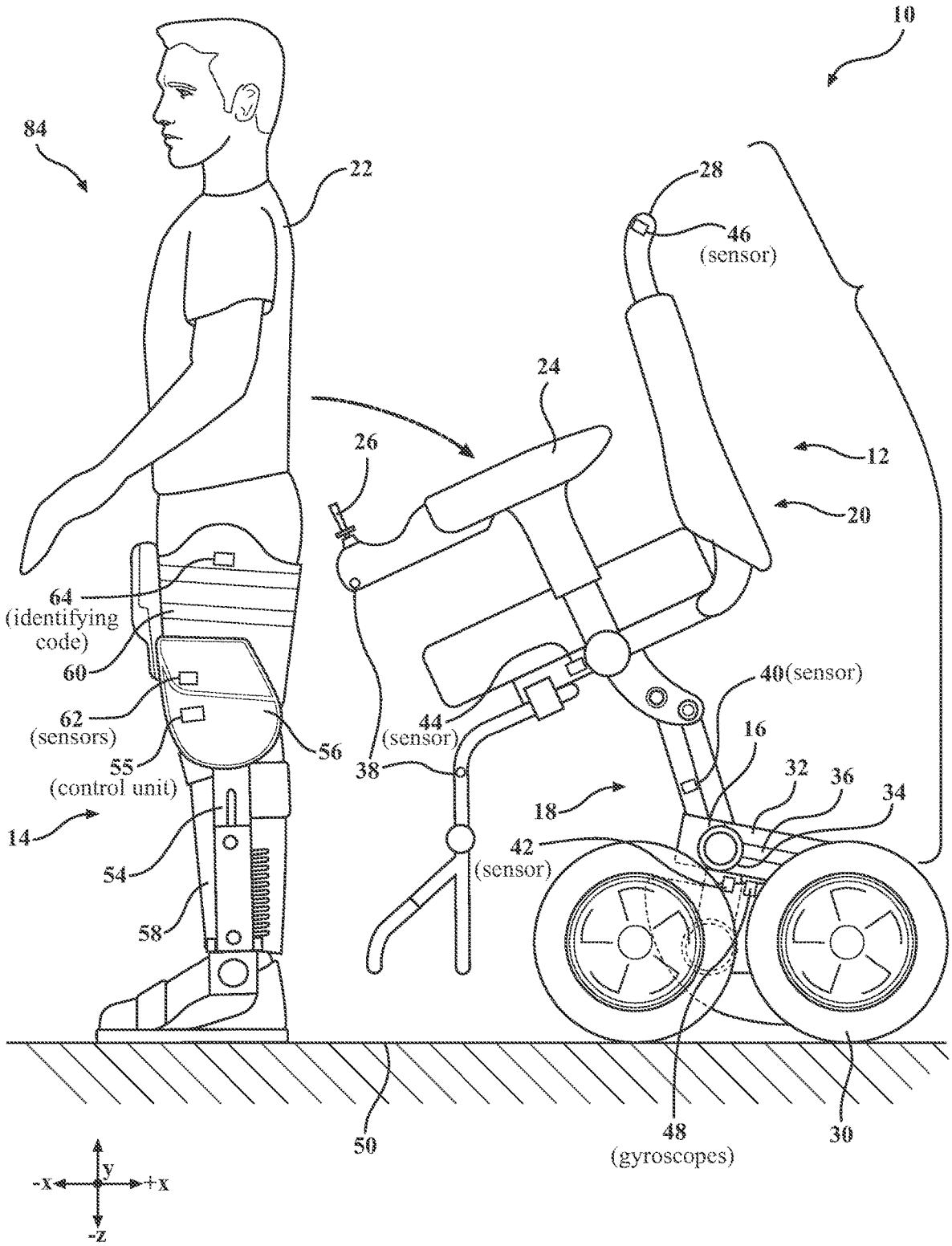
FIG. 1A schematically depicts an illustrative system having a communication system, a user-worn exoskeleton, and a powered wheelchair according to one or more embodiments shown or described herein.

As used herein, the term "system longitudinal direction" refers to the forward-rearward direction of the system (i.e., in a +/−X direction of the coordinate axes depicted in FIG. 1A). The term "system lateral direction" refers to the cross-direction (i.e., along the Y axis of the coordinate axes depicted in FIG. 1A), and is transverse to the longitudinal direction. The term "system vertical direction" refers to the upward-downward direction of the system (i.e., in the +/−Z-direction of the coordinate axes depicted in FIG. 1A). As used herein, "upper" or "top" is defined as generally being towards the positive Z direction of the coordinate axes shown in the drawings. "Lower" or "bottom" is defined as generally being towards the negative Z direction of the coordinate axes shown in the drawings.

A "conflict" as described herein generally relates to movements and/or motions of a particular device or component thereof that would negatively affect another particular device or component thereof, negatively affect movement of another particular device or component thereof, would cause undue stress on a user, and/or the like. For example, a conflict may occur when the individual movements of two separate components (e.g., a wheelchair and an exoskeleton) would cause a collision, cause one of the two components to operate outside of particular parameters, and/or the like. In another example, a conflict may occur when one or more components cause a user to move in a way that the user is physically incapable of moving, would cause discomfort the user, could potentially injure the user, or the like. That is, a conflict may occur when the wheelchair and/or the exoskeleton move too fast for the user.

Figure 1B:
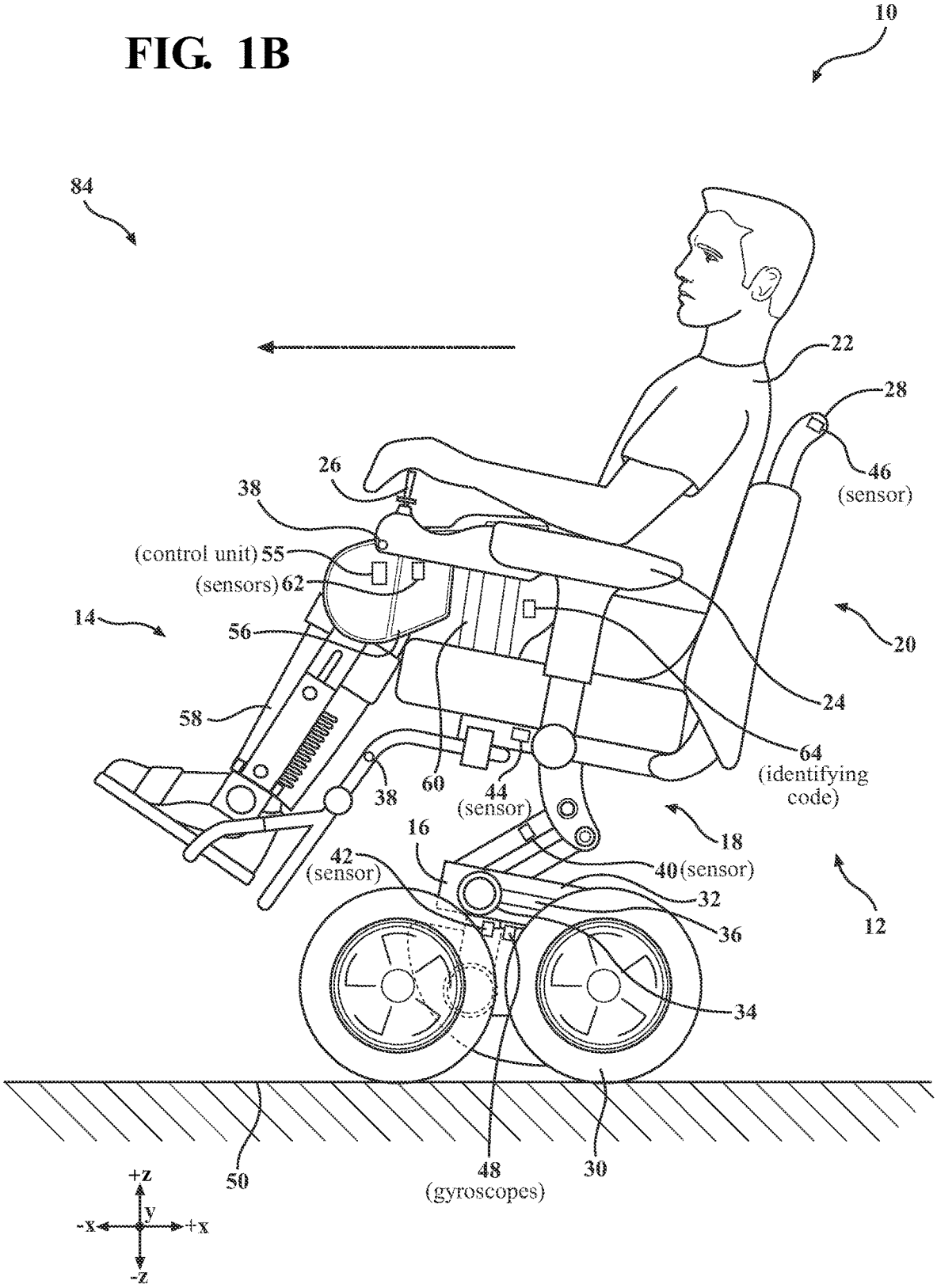
FIG. 1B schematically depicts the system of FIG. 1A when the user-worn exoskeleton and the powered wheelchair are controlled by the communication system according to one or more embodiments shown or described herein.

Referring initially to FIGS. 1A-1B, a schematic depiction of a system, generally designated 10, is provided. The system 10 generally includes a powered wheelchair 12, a user-worn exoskeleton 14, and a master controller 16. As described in greater detail herein, the system 10 may generally provide an ability to coordinate movements of the powered wheelchair 12 and the user-worn exoskeleton 14 via the master controller 16.

The powered wheelchair 12 is a generally recognized wheelchair that includes motorized components that allow a user to electronically control movement of the wheelchair. Accordingly, various components of the powered wheelchair 12 should be understood and are not described in further detail herein. The components of the powered wheelchair 12 may be standard components that are included with the wheelchair 12 or may be modular components that can be added to the wheelchair 12 based on a particular user's needs. For example, components such as leg rests, arms, wheels, backs, head rests, adapters for certain components, and/or the like may be modular and added to the wheelchair 12. Other modular components should generally be understood and are included within the scope of the present disclosure. In some embodiments, the powered wheelchair 12 may include a power base portion 18 and a seat 20 supported by the power base portion 18. Thus, the power base portion 18 is generally positioned below the seat 20 in a system vertical direction (i.e., positioned in the −z direction of the coordinate axes of FIG. 1A relative to the seat 20). Still referring to FIGS. 1A and 1B, in some embodiments, the power base portion 18 may raise, tilt, or otherwise move the seat 20. The seat 20 is generally configured to support a user 22 when the user 22 is seated in the powered wheelchair 12.

In some embodiments, the seat 20 may include at least one armrest 24 to which a controller 26 may be coupled. However, it should be understood that in some embodiments, the powered wheelchair 12 may not have any armrests and the controller 26 may be coupled to another portion of the powered wheelchair 12. As described herein the controller 26 may provide the user 22 with an ability to control movement of the powered wheelchair 12. In some embodiments, the controller 26 may be a joystick type controller where the user 22 directs the joystick in accordance with a desired direction and/or speed of travel. Accordingly, the controller 26 may be communicatively coupled to the power base portion 18, including various components thereof, to transmit signals to the power base portion 18 to cause the powered wheelchair 12 to respond according to the inputs received by the controller 26. It should be understood that the joystick configuration is merely illustrative, and in some embodiments, the controller 26 may utilize other designs, such as buttons, switches, voice controls, breath controls, and/or the like to receive inputs from a user.

In some embodiments, the seat 20 may include one or more handles 28 integrated therein or coupled thereto. The one or more handles 28 may provide an area for the user 22 to grip the powered wheelchair 12. For example, at least one of the one or more handles 28 may be located on a back portion of the seat 20 such that the user 22 may grasp the at least one handle when moving behind the powered wheelchair 12, as described in greater detail herein.

The power base portion 18 may include, but is not limited to, a plurality of wheels 30, an electronic control unit ("ECU") 32, a motor 34, a battery 36 and a master controller 16 The ECU 32 may generally be a control device that controls the powered wheelchair 12 and/or one or more components thereof. As such, the ECU 32 may be communicatively coupled to the various components of the powered wheelchair 12 such that one or more control signals can be transmitted from the ECU to the various components. In addition, the ECU 32 may be communicatively coupled to the master controller 16 such that signals can be transmitted/received to/from the master controller 16, as described in greater detail herein. The motor 34 may be coupled to the wheels 30 to drive movement of the wheels 30. The battery 36 may generally provide electrical power to the various components of the powered wheelchair 12. Other components of the power base portion 18 should generally be understood and are not described in further detail herein.

In some embodiments, the power base portion 18 and/or the seat 20 may have a plurality of cameras 38 mounted thereon. Each of the plurality of cameras 38 may be positioned to image a particular area surrounding the powered wheelchair 12 so to provide an observational view of the particular area on a display that is accessible to the user 22 when seated in the powered wheelchair 12.

In various embodiments, the powered wheelchair 12 may include a plurality of sensors, such as, for example, a power base position sensor 40, at least one power base location sensor 42, a seat position sensor 44, a handle sensor 46, and one or more gyroscopes 48. The various sensors may be collectively referred to herein as a first group of sensors 52.

As described in greater detail herein, the various sensors may generally be used to sense positioning of the powered wheelchair 12, movement, and/or the like so as to provide feedback during operation. More specifically, the first group of sensors 52 may transmit a plurality of outputs, either wired or wirelessly, to the master controller 16, as explained in greater detail herein. Each of the power base position sensor 40, the at least one power base location sensor 42, the seat position sensor 44, the handle sensor 46, and the one or more gyroscopes 48 may be a laser-based sensor, a proximity sensor, a level detection sensor, a pressure sensor, any combination thereof, and/or any other type of sensor that one skilled in the art may appreciate.

In various embodiments, the power base position sensor 40 may be configured to communicate the position of the power base portion 18 with respect to a floor surface 50 and/or the seat 20. For example, if the seat 20 is tilted and the power base portion 18 is on uneven terrain, information from the power base position sensor 40 may be used by the power base portion 18 to compensate for the tilt of the seat 20 in one direction. In various embodiments, the at least one power base location sensor 42 may communicate, for example, a location of the powered wheelchair 12 and/or obstacles or other information regarding the environment surrounding the powered wheelchair 12. For example, the at least one power base location sensor 42 may determine the location of the powered wheelchair 12 within a space such as the user's 22 home and compare that location with known obstacles, such as stairs or walls. In various embodiments, the seat position sensor 44 may communicate the position of the seat 20, such as the tilt of the seat 20 with respect to the power base portion 18, whether the tilt is forward or rearward, and/or the height of the seat 20. In various embodiments, the handle sensor 46 may sense and communicate whether the user 22 is in contact with (e.g., grabbing) the one or more handles 28.

The first group of sensors 52 may collectively provide data that is used to maintain a balance of the powered wheelchair 12 while climbing up and down stairs, curbs, and varied terrain, provide tracking data relating to the powered wheelchair 12, provide data that may be used to monitor a position, an angle, a tilt, a user's position, a speed, and/or a location the power base portion 18 and the seat 20, which may further be used for the purpose of controlling various movements of the powered wheelchair 12, such as a speed of the powered wheelchair 12, and/or the like.

The user-worn exoskeleton 14 may generally be any system, device, or collection of devices that assist the user 22 with one or more movements. For example, the user-worn exoskeleton may be a device that assists the user 22 with one or more upper extremity movements and/or one or more the lower extremity movements. In some embodiments, the user-worn exoskeleton may be an orthopedic device that replaces a missing joint or bone or a device that supports a damaged bone. While the present disclosure depicts the user-worn exoskeleton 14 as being located on the lower extremities of the user 22, it should be understood that this is merely illustrative. As such, the present disclosure is not limited to lower extremity user-worn exoskeletons. Moreover, while only a single user-worn exoskeleton 14 is depicted, the present disclosure is not limited to such. That is, a plurality of user-worn exoskeletons may be utilized in a similar manner without departing from the scope of the present disclosure. Various components, features, and uses of user-worn exoskeletons should generally be understood. As such, particular details of the user-worn exoskeleton 14 are not described in further detail herein.

In some embodiments, the user-worn exoskeleton 14 may include at least one actuator 54. The at least one actuator 54 may assist the user 22 in completing a particular movement. In some embodiments, the at least one actuator 54 may be positioned at or near a particular location on the user's body, such as, for example at a joint 56. As particularly shown in FIGS. 1A and 1B, the actuator 54 is positioned at the user's a knee joint. However, the actuator may be positioned at other locations of the user's body without departing from the scope of the present disclosure.

In various embodiments, the at least one actuator 54 may be positioned and arranged such that, when the user-worn exoskeleton 14 assists the user 22 in completing a movement, the at least one actuator 54 may move a first portion 58 of the user-worn exoskeleton 14 with respect to a second portion 60 of the user-worn exoskeleton 14 so to assist a particular motion or movement (e.g., assisting the user 22 in bending his/her knee). As such, the user-worn exoskeleton 14 may be particularly configured in some embodiments to assist the user 22 with a walking motion, a standing motion, and/or a sitting motion. It should be understood that while FIGS. 1A and 1B only depict a single one of the at least one actuator 54, this is a non-limiting example. That is, the user-worn exoskeleton 14 may include a plurality of actuators 54 in some embodiments.

In some embodiments, the at least one actuator 54 may be controllable by a control unit 55. The control unit 55 is not limited by this disclosure, and may generally any device that provides control signals to the at least one actuator 54 to cause the at least one actuator 54 to actuate. As such, the control unit 55 may be communicatively coupled to each one of the at least one actuator 54. In addition, the control unit 55 may be communicatively coupled to the master controller 16 such that the control unit 55 can transmit/receive signals to/from the master controller 16.

In various embodiments, the user-worn exoskeleton 14 may include a second group of sensors 62 positioned at various locations with respect to the user 22 and/or the user-worn exoskeleton 14. For example, as depicted in FIGS. 1A and 1B, the second group of sensors 62 may include at least one sensor positioned at or near the joint 56 and/or another place of movement, such that the movement may be sensed by the second group of sensors 62 and corresponding data may be transmitted. Accordingly, the second group of sensors 62 may transmit data to the master controller 16. The data may include, for example, data relating to whether a movement has occurred, data relating to whether the user-worn exoskeleton 14 has no movement, and/or data relating to a degree of movement. Each of the second group of sensors 62 may include a laser-based sensor, a proximity sensor, a level detection sensor, a pressure sensor, and/or any combination thereof, or the like.

In some embodiments, the user-worn exoskeleton 14 may further include one or more features for identifying the user-worn exoskeleton 14 such that the user-worn exoskeleton 14 can be paired to the master controller 16 to receive one or more commands from the master controller 16, as described in greater detail herein. In some embodiments, the one or more features may include an identifying code 64. Illustrative examples of an identifying code 64 include, but are not limited to, a near field code, a bar code, a QR code, and a serial code. The master controller 16 may use the identifying code 64 to identify the user-worn exoskeleton 14 and initiate communication with the user-worn exoskeleton 14. For example, the master controller 16 may obtain image data that corresponds to the one or more features (e.g., the identifying code 64), identify the user-worn exoskeleton 14 from the one or more features, and connect to the user-worn exoskeleton 14. As such, the pairing of the master controller 16 to the user-worn exoskeleton 14 may assist the master controller 16 in determining the type of user-worn exoskeleton, how many exoskeletons, the control unit of the exoskeleton, and/or the like.

The master controller 16 may generally be a standalone control device that contains one or more components for controlling movement of the powered wheelchair 12 and/or the user-worn exoskeleton 14. It should be appreciated that while the master controller 16 is shown in FIGS. 1A and 1B as part of the powered wheelchair 12, this is a non-limiting example. That is, the master controller 16 may be a device that is separate from the powered wheelchair 12, such as a device that is coupled to or integrated with the user-worn exoskeleton 14. In some embodiments, the master controller 16 may be separate from both the powered wheelchair 12 and the user-worn exoskeleton 14, such as, for example, a user carried computing device, the user's mobile device, or the like.

Figure 2:
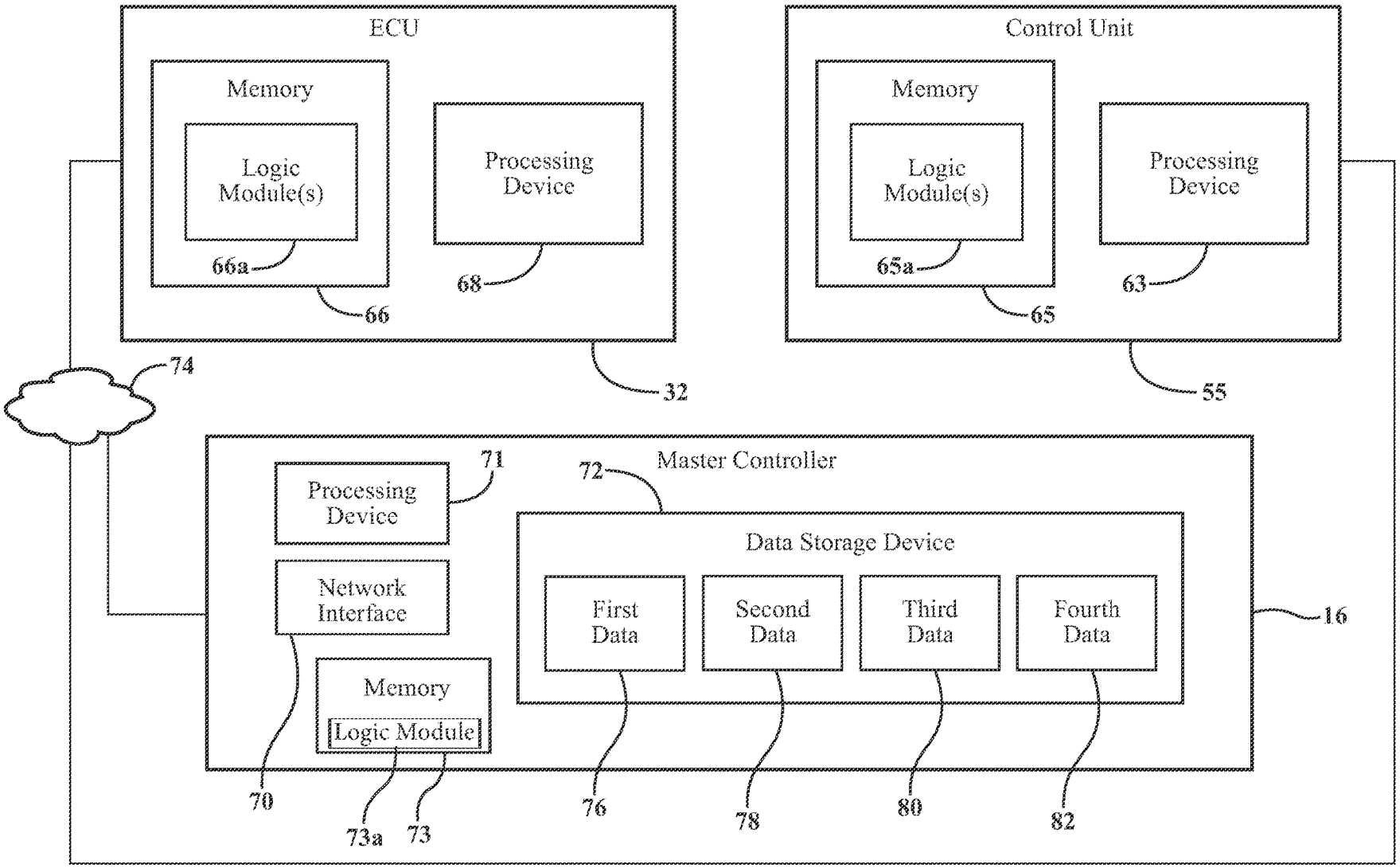
FIG. 2 schematically depicts a block diagram of illustrative components of a communication system according to one or more embodiments shown or described herein.

FIG. 2 depicts various illustrative internal components of the master controller 16, internal components of the ECU 32, and internal components of the control unit 55 communicatively coupled together according to embodiments. More specifically, the master controller 16 may be communicatively coupled to the ECU 32 and the control unit 55 via a network 74. The network 74 may include a wide area network (WAN), such as the Internet, a local area network (LAN), a mobile communications network, a public service telephone network (PSTN), a personal area network (PAN), a metropolitan area network (MAN), a virtual private network (VPN), and/or another network that can electronically connected the master controller 16, the ECU 32, and the control unit 55 together.

In various embodiments, the ECU 32 may include, but is not limited to, a memory component 66 and a processing device 68. The processing device 68, such as a computer processing unit (CPU), may be the central processing unit of the ECU 32, performing calculations and logic operations to execute a program. The processing device 68, alone or in conjunction with the other components, is an illustrative processing device, computing device, processor, or combination thereof. The processing device 68 may include any processing component configured to receive and execute instructions (such as from the memory component 66).

In some embodiments, the memory component 66 may be configured as a volatile and/or a nonvolatile computer-readable medium and, as such, may include random access memory (including SRAM, DRAM, and/or other types of random access memory), read only memory (ROM), flash memory, registers, compact discs (CD), digital versatile discs (DVD), and/or other types of storage components. Further, the memory component 66 may be a non-transitory, processor-readable memory. The memory component 66 may include one or more programming instructions thereon that, when executed by the processing device 68, cause the processing device 68 to complete various processes, such as one or more of the processes described herein with respect to FIGS. 3, 4, 5B, and 6C.

Still referring to FIG. 2, the programming instructions stored on the memory component 66 may be embodied as one or more software logic modules 66*a*, where each logic module 66*a* provides programming instructions for completing one or more tasks, as described in greater detail below with respect to FIGS. 3, 4, 5B, and 6C. Still referring to FIG. 2, the logic module 66*a* includes a plurality of different pieces of logic, each of which may be embodied as a computer program, firmware, and/or software/hardware, which may be executable by the processing device 68.

In various embodiments, the control unit 55 may include, but is not limited to, a memory component 65 and a processing device 63. The processing device 63, such as a computer processing unit (CPU), may be the central processing unit of the control unit 55, performing calculations and logic operations to execute a program. The processing device 63, alone or in conjunction with the other components, is an illustrative processing device, computing device, processor, or combination thereof. The processing device 63 may include any processing component configured to receive and execute instructions (such as from the memory component 65).

In some embodiments, the memory component 65 may be configured as a volatile and/or a nonvolatile computer-readable medium and, as such, may include random access memory (including SRAM, DRAM, and/or other types of random access memory), read only memory (ROM), flash memory, registers, compact discs (CD), digital versatile discs (DVD), and/or other types of storage components. Further, the memory component 65 may be a non-transitory, processor-readable memory. The memory component 65 may include one or more programming instructions thereon that, when executed by the processing device 63, cause the processing device 63 to complete various processes, such as one or more of the processes described herein with respect to FIGS. 3, 4, 5B, and 6C.

Still referring to FIG. 2, the programming instructions stored on the memory component 65 may be embodied as one or more software logic modules 65*a*, where each logic module 65*a* provides programming instructions for completing one or more tasks, as described in greater detail below with respect to FIGS. 3, 4, 5B, and 6C. Still referring to FIG. 2, the logic module 65*a* includes a plurality of different pieces of logic, each of which may be embodied as a computer program, firmware, and/or software/hardware, which may be executable by the processing device 63.

In various embodiments, the master controller 16 includes a network interface 70, a processing device 71, a data storage device 72, and a memory 73. The processing device 71, such as a computer processing unit (CPU), may be the central processing unit of the master controller 16, performing calculations and logic operations to execute a program. The processing device 71, alone or in conjunction with the other components, is an illustrative processing device, computing device, processor, or combination thereof. The processing device 71 may include any processing component configured to receive and execute instructions (such as from the memory component 73).

In some embodiments, the memory component 73 may be configured as a volatile and/or a nonvolatile computer-readable medium and, as such, may include random access memory (including SRAM, DRAM, and/or other types of random access memory), read only memory (ROM), flash memory, registers, compact discs (CD), digital versatile discs (DVD), and/or other types of storage components. Further, the memory component 73 may be a non-transitory, processor-readable memory. The memory component 73 may include one or more programming instructions thereon that, when executed by the processing device 71, cause the processing device 71 to complete various processes, such as one or more of the processes described herein with respect to FIGS. 3, 4, 5B, and 6C.

Still referring to FIG. 2, the programming instructions stored on the memory component 73 may be embodied as one or more software logic modules 73*a*, where each logic module 73*a* provides programming instructions for completing one or more tasks, as described in greater detail below with respect to FIGS. 3, 4, 5B, and 6C. Still referring to FIG. 2, the logic module 73*a* includes a plurality of different pieces of logic, each of which may be embodied as a computer program, firmware, and/or software/hardware, which may be executable by the processing device 71.

The network interface 70 of the master controller 16 may include any wired or wireless networking hardware, such as a modem, LAN port, wireless fidelity (Wi-Fi) card, WiMax card, mobile communications hardware, and/or other hardware for communicating with other networks and/or devices. Therefore, the communication between the master controller 16, the powered wheelchair 12, and/or the user-worn exoskeleton 14 may be provided through the network interface 70. In one example, the master controller 16 may wirelessly communicate with the user-worn exoskeleton 14 and the powered wheelchair 12.

It should be appreciated that the user controls and/or a user initiated programs, as discussed in greater detail herein, may be transmitted to the master controller 16 through the network interface 70. Further, it should be appreciated that the user 22 may select the user initiated programs by voice control, voice activation, a push button or a from a program selection initiated at an external device from the master controller 16 such as a portable computing device, smartphone, or the like, or from the user-worn exoskeleton 14.

The data storage device 72, which may generally be a storage medium, may contain one or more data repositories for storing data that is received and/or generated. The data storage device 72 may be any physical storage medium, including, but not limited to, a hard disk drive (HDD), memory, removable storage, and/or the like. While the data storage device 72 is depicted as a local device, it should be understood that the data storage device 72 may be a remote storage device, such as, for example, a server computing device or the like. Illustrative data that may be contained within the data storage device 72 is described below with respect to FIGS. 3, 4, 5B, and 6C and includes. but is not limited to first data 76 from the second group of sensors 62 of the user-worn exoskeleton 14 (FIGS. 1A-1B), second data 78 from the first group of sensors 52 of the powered wheelchair 12, third data 80 from a plurality of sensors located on the seat 20 and fourth data 82 generated by the user 22.

The data storage device 72 stores the data as received from the first group of sensors 52, the second group of sensors 62, the third data 80, and/or the fourth data 82 as discussed herein. The master controller 16 may utilize the data within the data storage device 72 from the first data 76, the second data 78, the third data 80, the fourth data 82, and so on, to coordinate a movement, multiple movements, or resolve a conflict between the powered wheelchair 12 and/or the user-worn exoskeleton 14 (FIGS. 1A and 1B) as discussed in greater detail herein.

Referring also to FIGS. 1A and 1B, one or more proximity switches may be positioned so as to detect whether the user 22 is sitting in the seat 20 of the powered wheelchair 12 and generate data corresponding thereto. The data storage device 72 may receive and store this data as the first data 76, the second data 78, and/or as the third data 80. The master controller 16 may analyze the first data 76, the second data 78, and/or the third data 80 to determine whether the data is indicative of potential issues. If a conflict occurs between the powered wheelchair 12 and the user-worn exoskeleton 14, the master controller 16 may determine that such a conflict exists from the received first data 76, the second data 78, and third data 80 and may transmit one or more commands to the ECU 32. The ECU 32 may in turn may permit and/or inhibit a movement of the powered wheelchair 12 and/or the user-worn exoskeleton 14 to avoid such a conflict.

In some embodiments, under one operation, the powered wheelchair 12 and the user-worn exoskeleton 14 may move independently of one another within particular parameters. As such, the particular parameters may be predetermined logic programs that are stored in the logic module 66*a* and initiated during independent operation of the powered wheelchair 12 and the user-worn exoskeleton 14. Under another operation, a program stored in the logic module 66*a* may be accessed and executed whereby the master controller 16 may coordinate the movements of the powered wheelchair 12 and the user-worn exoskeleton 14 so to achieve a particular function, movement, and/or the like, such as providing a user with assistance in embarking and/or disembarking from the powered wheelchair 12, using the powered wheelchair 12 as a walker or guide, and/or assisting the user with standing and/or sitting motions. In some embodiments, the operations may be completed on the fly (i.e., as the user actively attempts to complete various tasks) or may be completed as a preset program (i.e., to move the user through a preset set of steps as part of a rehab program, a training program, and/or the like).

In some embodiments, during coordinated movement, the master controller 16 may monitor and may refer to the first data 76, the second data 78, the third data 80 and/or the fourth data 82 so to determine a position, an orientation, and/or the like of the user-worn exoskeleton 14 and the powered wheelchair 12, as discussed above. The master controller 16 may then concurrently provide instruction signals to the ECU 32 and/or the control unit 55 to move the respective components of the powered wheelchair 12 and/or the user-worn exoskeleton 14 as appropriate.

It should be understood that while some of the components of FIG. 2 are illustrated as residing within the master controller 16 while others reside within the ECU 32 and/or the control unit 55, this is merely an example thereof. In some embodiments, one or more of the components may reside solely within the master controller 16, or, in the alternative, one or more components may be external to the ECU 32, the control unit 55 and to the master controller 16.

It should also be appreciated that the master controller 16 may receive new and/or updated instructions or configurations as needed. It should also be appreciated that the logic module 66*a*, the memory component 66 and/or the processing device 68 may also receive updates and/or new user initiated programs from time to time. These updates may be based on the user 22 and the type of powered wheelchair 12 and/or or the type of user-worn exoskeleton 14. Moreover, the user 22 or a remote third party, such as a physician, may use an application installed on a smart device, tablet, wearable, or a computer that communicates with the master controller 16 so to select the user initiated program or to provide a manual control of the powered wheelchair 12 and/or the user-worn exoskeleton 14 so to facilitate movement, update the master controller 16, and/or further program the master controller 16.

As discussed herein, in some embodiments, the master controller 16 may determine whether a conflict is present between the user-worn exoskeleton 14 and the powered wheelchair 12 during normal independent operation of the user-worn exoskeleton 14 and the powered wheelchair 12. In this embodiment, the master controller 16 may automatically determine whether a conflict is present between the user-worn exoskeleton 14 and the powered wheelchair 12 without an input required from the user 22. For instance, the user 22 may have a musculoskeletal injury where the user 22 has partial paralysis. As such, the user 22 may need the assistance in movement while in the powered wheelchair 12 as well as while out of the powered wheelchair 12. Therefore, the user-worn exoskeleton 14 may independently move from the powered wheelchair 12. As a result, a conflict may occur between the powered wheelchair 12 and the user-worn exoskeleton 14 without the user 22 knowing or aware of any conflict. For example, the user 22 may be utilizing the user-worn exoskeleton 14 to sit into the powered wheelchair 12 and the user 22 bumps the controller 26 of the powered wheelchair, which may create a conflict between the movements of user-worn exoskeleton 14 and the movement of the powered wheelchair 12. The master controller 16 may override the independent movements of the user-worn exoskeleton 14 and the powered wheelchair to permit movement of the user-worn exoskeleton 14 and/or the powered wheelchair 12 to operate in a manner that avoids the conflict, as discussed in greater detail herein.

In other embodiments, the master controller 16 may monitor for an input generated by a user initiated programs, which may be requested by the user 22 and/or remotely by a third party. The user initiated programs may correspond to one or more particular functions whereby the powered wheelchair 12 and the user-worn exoskeleton 14 have coordinated movements by the master controller 16. Specific examples will be discussed in greater detail herein.

In either embodiment, the master controller 16 may monitor the first group of sensors 52 for a plurality of predetermined parameters such that various characteristics (e.g., positioning) of the user-worn exoskeleton 14, the powered wheelchair 12, and/or the user 22 can be used for determining whether to execute a particular program or the like. Illustrative examples of the various characteristics may include, but are not limited to, a location of the powered wheelchair 12 and/or obstacles surrounding the powered wheelchair 12, a tilt of the seat 20 and whether the tilt is forward or rearward, a position of the power base portion 18 with respect to the floor surface 50, whether the user 22 is in contact with and/or grabbing the one or more handles 28, the location of the user-worn exoskeleton 14 relative to the user 22 and/or the powered wheelchair 12, a movement of the user-worn exoskeleton 14, a location and/or a movement of the at least one actuator 54 (FIGS. 1A-1B), a position or a movement of the joint 56, and a position of the first portion 58 relative to the second portion 60.

Figure 3:
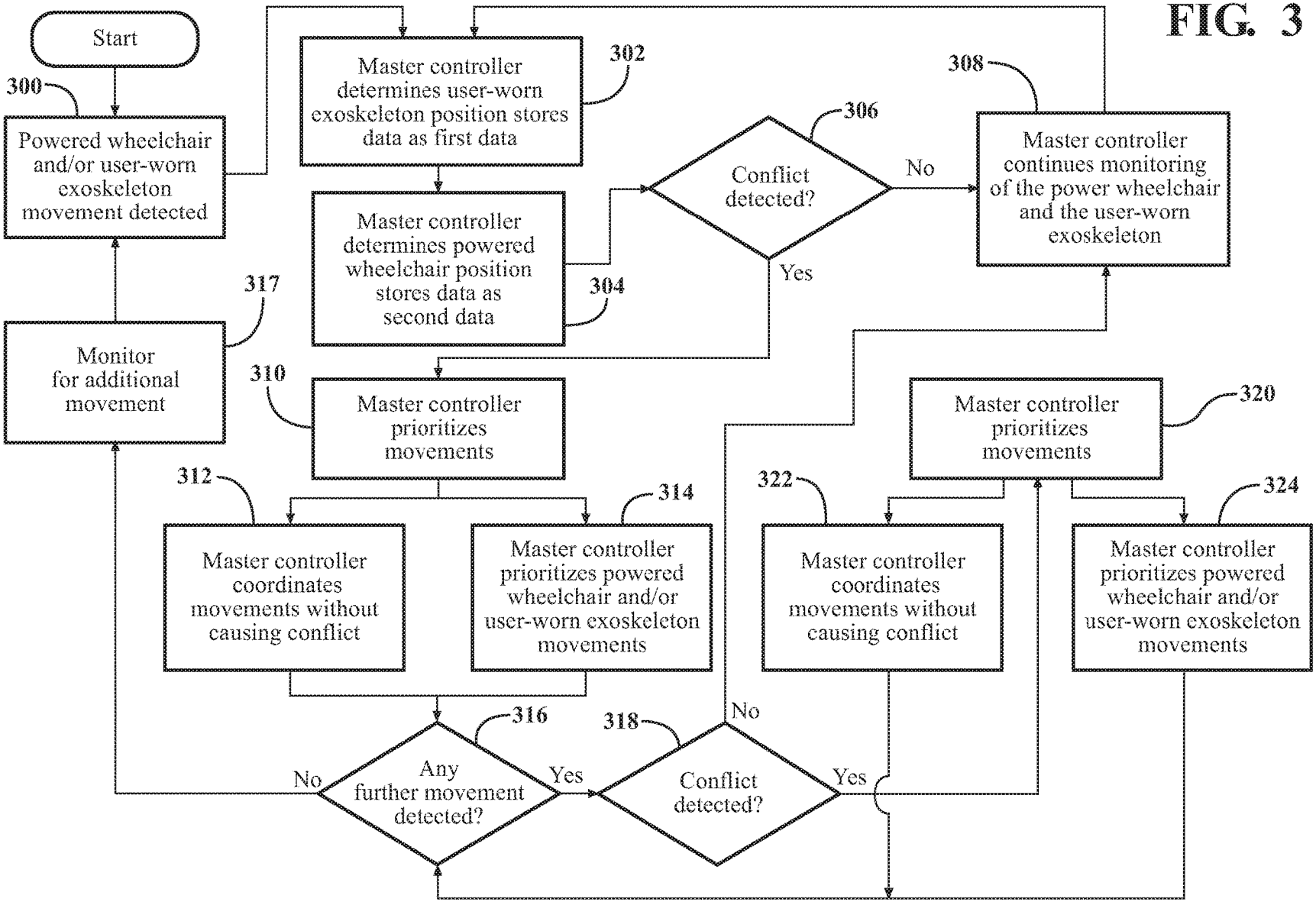
FIG. 3 depicts a flowchart of an illustrative method carried out by a master controller in communication with the powered wheelchair and the user-worn exoskeleton of FIG. 1A according to one or more embodiments shown or described herein.

Now referring to FIG. 3, a flowchart of an illustrative method of communication between the master controller 16, the powered wheelchair 12, and the user-worn exoskeleton 14 of FIG. 1A is depicted. In some embodiments, the master controller 16 may be in continuous communication with the powered wheelchair 12 and the user-worn exoskeleton 14 to execute the various steps depicted in FIG. 3. The master controller 16 may monitor for movement of the powered wheelchair 12 and/or the user-worn exoskeleton 14 and detect such movement at step 300. Once a movement is detected, the master controller 16 may determine a positioning of the user-worn exoskeleton 14 (or components thereof) by obtaining information from the second group of sensors 62 and may store the information as the first data 76 at step 302. The master controller 16 may also determine a positioning of the powered wheelchair 12 (or components thereof) by obtaining information from the first group of sensors 52 and may store the information as the second data 78 at step 304. With the various positioning information of the user-worn exoskeleton 14 and the powered wheelchair 12 stored and with movement detected, the master controller 16 may determine whether a conflict is present for a particular movement of the powered wheelchair 12 and/or the user-worn exoskeleton 14 at step 306. If a conflict is not present (i.e., the respective movements of the powered wheelchair 12 and the user-worn exoskeleton 14 do not conflict one another), the master controller 16 may continue to monitor additional movements of the powered wheelchair 12 and the user-worn exoskeleton 14 while the respective movements of the powered wheelchair 12 and the user-worn exoskeleton 14 are not hindered by the master controller 16 at step 308. The process may further return to step 302 upon detection of a subsequent movement.

If the master controller 16 determines that a conflict is present between the powered wheelchair 12 and the user-worn exoskeleton 14 based on the respective movements (or intended movements) thereof, the master controller 16 may prioritize the movements at step 310, such that either of the following may occur: the powered wheelchair 12 and the user-worn exoskeleton 14 are coordinated in a movement together that does not cause a conflict at step 312, or, in the alternative, the master controller 16 prioritizes the movement of the powered wheelchair 12 and the user-worn exoskeleton 14 such that only one of the powered wheelchair 12 and the user-worn exoskeleton 14 has priority to complete the intended movement at step 314. In such an instance where only one of the powered wheelchair 12 and the user-worn exoskeleton 14 has priority, the master controller 16 may further alter the movements of the component that does not have priority, either by restricting all movements or modifying the movements to avoid the conflict.

Once the movement is complete, the master controller 16 may again monitor for any movement requests between the powered wheelchair 12 and the user-worn exoskeleton 14 at step 316. If there is not any further movement and/or a movement request is not detected, the master controller 16 device may monitor for additional movement(s) or movement request(s) at step 317, whereby the process returns to step 300.

On the other hand, if movement or if the movement request is detected by the master controller 16, the master controller 16 may determine whether conflict is present at step 318. If conflict in the movement is not present, the master controller 16 may continue to monitor additional movements of the powered wheelchair 12 and the user-worn exoskeleton 14 while the respective movements of the powered wheelchair 12 and the user-worn exoskeleton 14 are not hindered by the master controller 16 at step 308. The process may further return to step 302 upon detection of a subsequent movement.

However, if movement or if the movement request is detected by the master controller 16 and a conflict in the movements is determined to be present at step 318, the master controller 16 may again prioritize the powered wheelchair 12 and the user-worn exoskeleton 14 movements at step 320, such that either of the following may occur: the powered wheelchair 12 and the user-worn exoskeleton 14 are coordinated in a movement together that does not cause a conflict at step 322, or, in the alternative, the master controller 16 prioritizes the movement of the powered wheelchair 12 and the user-worn exoskeleton 14 such that only one of the powered wheelchair 12 and the user-worn exoskeleton 14 has priority to complete the movement or intended movement at step 324. In such an instance where only one of the powered wheelchair 12 and the user-worn exoskeleton 14 has priority, the master controller 16 may further alter the movements of the component that does not have priority, by either restricting all movements or modifying the movements to avoid the conflict.

Once the movement is complete, the master controller 16 may again monitor for any movement requests between the powered wheelchair 12 and the user-worn exoskeleton 14 at step 316. If movement and/or movement request is not detected, the master controller 16 device may monitor for additional movement(s) or movement request(s) at step 317, whereby the process returns to step 300.

If movement or if the movement request is detected by the master controller 16, the master controller 16 may determine whether conflict is present at step 318. If conflict in the movement is not present, the master controller 16 may continue to monitor additional movements of the powered wheelchair 12 and the user-worn exoskeleton 14 while the respective movements of the powered wheelchair 12 and the user-worn exoskeleton 14 are not hindered by the master controller 16 at step 308. The process may further return to step 302 upon detection of a subsequent movement.

It should be appreciated that the processes described with respect to FIG. 3 are arranged as a loop that continues for as long as a movement or an indication of an intended movement thereof is sensed.

As discussed herein, in some embodiments, the data storage device 72 may store one or more user initiated inputs as the fourth data 82. In such embodiments, when a user-initiated input is received, the master controller 16 may trigger the user initiated programs. The user initiated programs may be received from the user 22 or from a remote third party (i.e., an individual, computing device, or the like that is not the user 22). The user initiated programs may correspond to one or more particular functions whereby the master controller 16 coordinates a plurality of movements of the powered wheelchair 12 and the user-worn exoskeleton 14. Alternatively, the user initiated programs may correspond to one or more particular functions whereby the master controller 16 permits independent movement of the powered wheelchair 12 and the user-worn exoskeleton 14 within a particular set of parameters, as opposed to free independent movement and conflict prevention, as discussed herein. As such, particular programs that address particular instances may be loaded onto the logic module 66*a* and executed by the master controller 16, the ECU 32, and/or the control unit 55. Three illustrative examples will be discussed in greater detail below.

Figure 4:
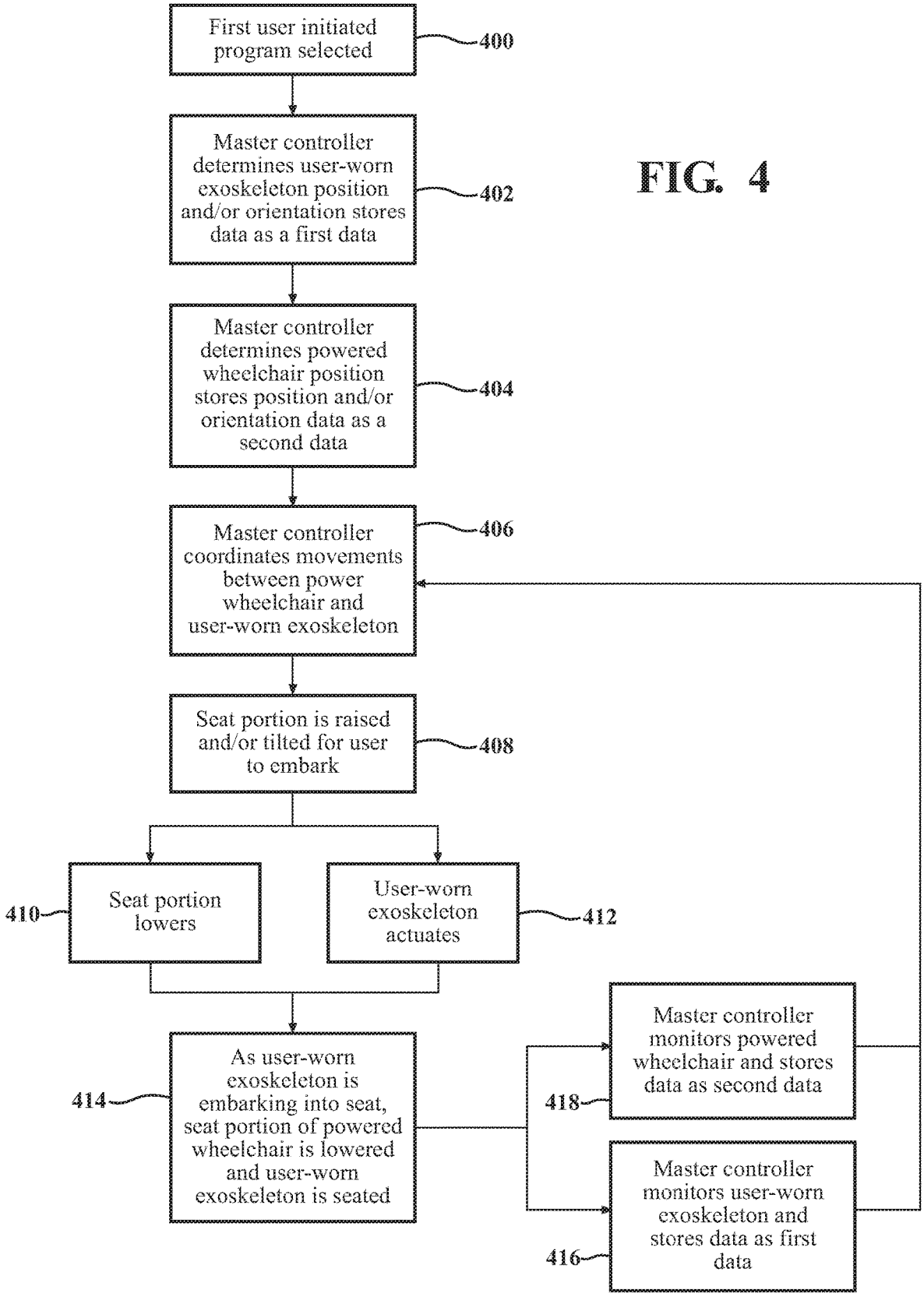
FIG. 4 depicts a flowchart of illustrative processes completed during a first user initiated program according to one or more embodiments shown or described herein.

Referring to FIG. 4, a flowchart of an illustrative method of executing a first user-initiated program by the master controller 16, the user-worn exoskeleton 14, and/or the powered wheelchair 12 is depicted. The first user initiated program 84 may be embedded in logic module 66*a* and may be executable by the master controller 16, as discussed herein. When an input corresponding to a request to initiate the first user initiated program 84 is received, the master controller 16 may coordinate a plurality of synchronized movements by the powered wheelchair 12 and the user-worn exoskeleton 14 such that the powered wheelchair 12 raises the seat 20 in a system vertical direction (i.e., in the +z/−z directions of the coordinate axes of FIG. 1A) to assist the user 22 in sitting into the powered wheelchair 12.

Once the first user initiated program 84 is selected at step 400, the master controller 16 determines the position and/or orientation of the user-worn exoskeleton 14 using the second group of sensors 62 and storing the data into the data storage device 72 as the first data 76 at step 402. The master controller 16 also determines the position and/or orientation of the powered wheelchair 12 using the first group of sensors 52 and stores the data into the data storage device 72 as second data 78 at step 404. Based upon the positioning of the user-worn exoskeleton 14 and the powered wheelchair 12, the master controller 16 may direct one or more movements of the powered wheelchair 12 and the user-worn exoskeleton 14 at step 406 such that the user-worn exoskeleton 14 and the powered wheelchair 12 move in a manner so as to assist the user 22 from a standing position to a sitting position in the powered wheelchair 12. As such, the seat 20 may be moved to a raised position in the system vertical direction (i.e., in the +z/−z directions of the coordinate axes of FIG. 1A) and/or tilted in such a manner to receive the user 22 at step 408. The seat 20 is lowered at step 410 while the user-worn exoskeleton 14 actuates so to move or rotate the first portion 58 relative to the second portion 60 at the joint 56 of the user-worn exoskeleton 14 at step 412. This process continues until the user 22 is fully seated, the seat 20 is lowered, and the user-worn exoskeleton 14 is positioned within the powered wheelchair 12 at step 414. During these coordinated movements, the first group of sensors 52 and the second group of sensors 62 may continuously provide data to the data storage device 72 such that the master controller 16 may continue to monitor the data at step 418. This process of data monitoring and coordinating movements may be repeated at step 406 until the first user initiated program 84 complete.

It should be appreciated that the master controller 16 monitors the first data 76 and the second data 78 to ensure that the movements between the user-worn exoskeleton 14 and the powered wheelchair 12 are coordinated or synchronized such that the user 22 may be seated into the powered wheelchair 12 without using the controller 26 of the powered wheelchair 12. As such, and as will be apparent to those skilled in the art, the master controller 16 continuously monitors the first group of sensors 52 of the powered wheelchair 12 for the location of the powered wheelchair 12 with reference to the user 22 and with reference to surrounding obstacles. Further, the seat 20 location is also monitored and the height is determined with reference to the user 22 position and the power base portion 18. The user-worn exoskeleton 14 is monitored for the movements and the position relative to the seat 20 and the powered wheelchair 12.

During the seating or embarking process, the seat 20 may tilt to provide a better embarking experience for the user 22 and, as the seat 20 is lowered, the seat 20 may return to a neutral position (e.g., a parallel seat placement with reference to a floor surface 50) at step 414.

Once seated, the master controller 16 may further coordinate one or more user-worn exoskeleton 14 movements and/or may guide the powered wheelchair 12 into a plurality of movements while inhibiting the user-worn exoskeleton 14 so as to not allow the user 22 to stand or to lower an extremity while the powered wheelchair 12 is in motion.

It should be appreciated that the process depicted in FIG. 4 indicates that the process is only in a single direction. However, this is for illustrative purposes merely to explain a single iteration or loop of the program. It should be appreciated that the process may work in reverse order to assist the user 22 in disembarking from the powered wheelchair 12. Further, it should be appreciated that the process may continuously monitor, communicate, change, and/or modify a position of the powered wheelchair 12 and/or the user-worn exoskeleton 14 as necessary. It should also be appreciated that these are merely examples of the first user initiated program 84 and that there are a plurality of movements between the powered wheelchair 12 and the user-worn exoskeleton 14 that may occur to assist in the transportation of the user 22 from one position to another.

Figure 5A:
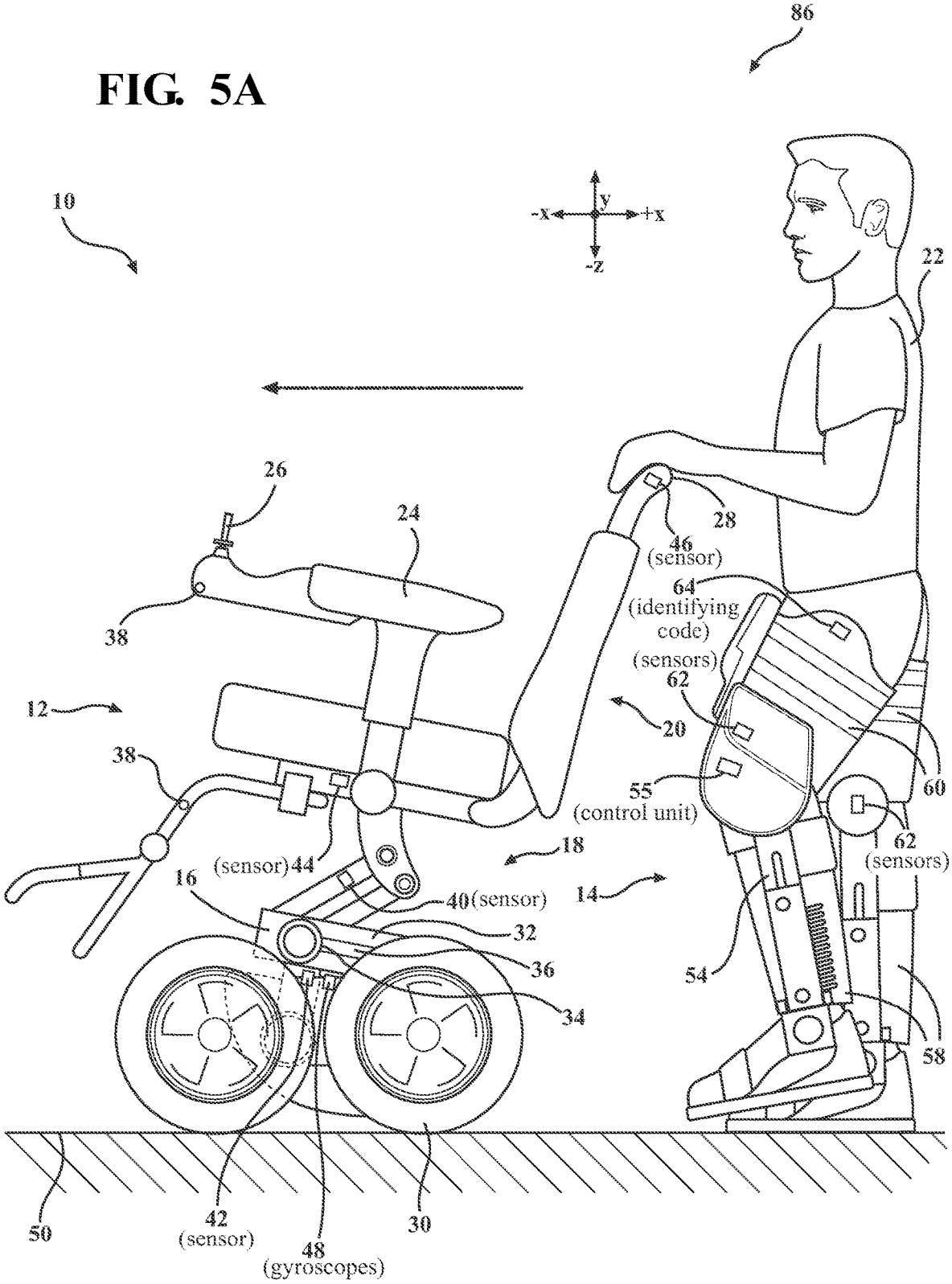
FIG. 5A schematically depicts an illustrative use of the system of FIG. 1A according to one or more embodiments shown or described herein.
Figure 5B:
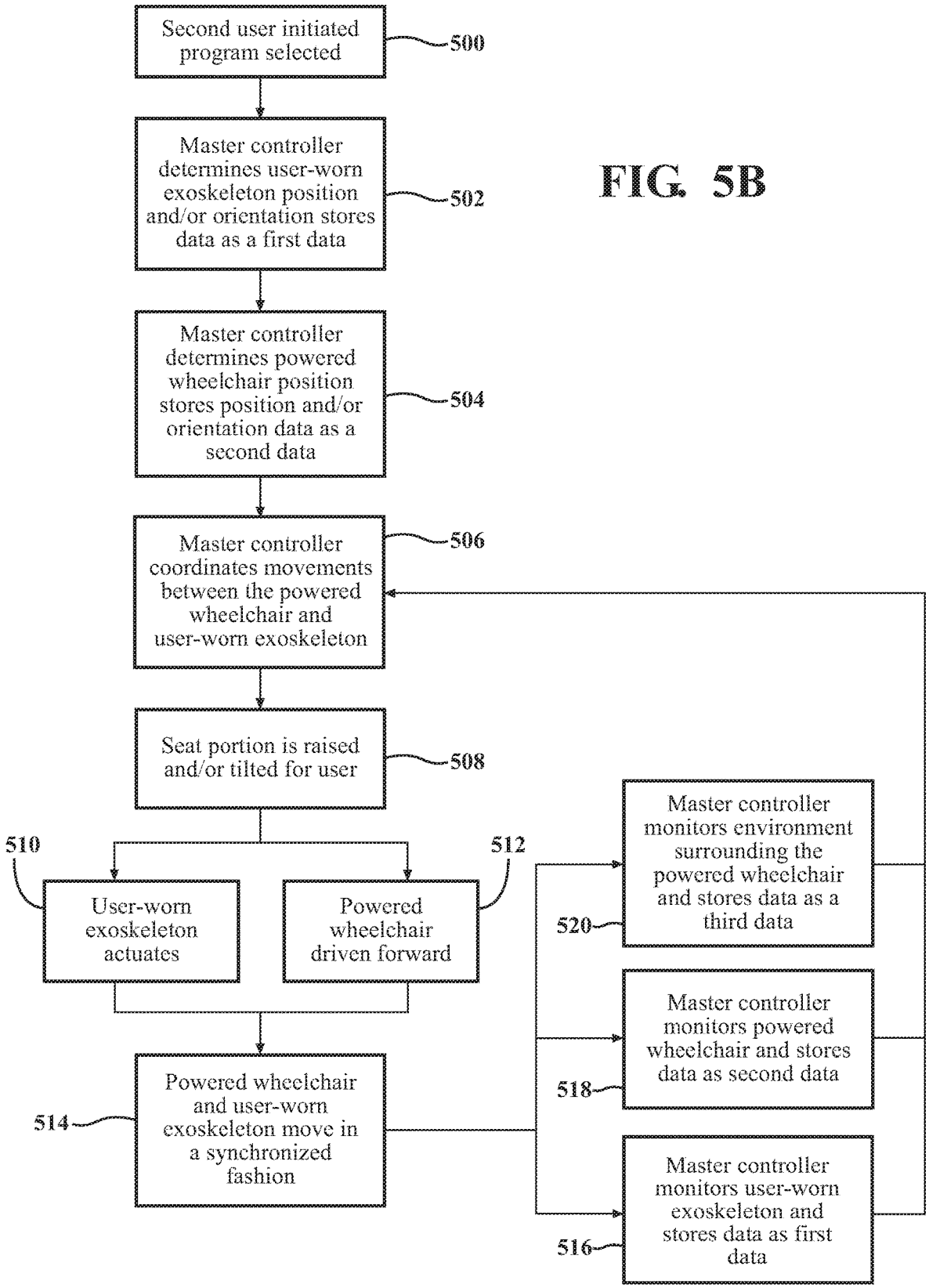
FIG. 5B depicts a flowchart of illustrative processes completed during a second user initiated program according to one or more embodiments shown or described herein.

FIG. 5A schematically depicts an illustrative use of the system of FIG. 1A. FIG. 5B depicts a flowchart of illustrative processes completed during a second user initiated program. The second user initiated program 86 may be embedded in logic module 66*a* and may be executable by the master controller 16, as discussed herein. When an input for the second user initiated program 86 is received, the master controller 16 may coordinate a plurality of synchronized movements by the powered wheelchair 12 and the user-worn exoskeleton 14 such that the powered wheelchair 12 assists the user 22 as a walker or a guide in the system longitudinal direction (i.e., in the +x/−x directions of the coordinate axes of FIG. 1A). In particular, the user 22 grips the one or more handles 28 of the powered wheelchair 12. While the user 22 is in contact with the one or more handles 28, the master controller 16 coordinates the powered wheelchair 12 and the user-worn exoskeleton 14 such that the powered wheelchair 12 and the user-worn exoskeleton 14 movements are synchronized. Once the second user initiated program 86 is selected at step 500, the master controller 16 determines the position and/or orientation of the user-worn exoskeleton 14 using the second group of sensors 62 and stores the data into the data storage device 72 as the first data 76 at step 502. The master controller 16 also determines the position and/or orientation of the powered wheelchair 12 using the first group of sensors 52 and stores the data into the data storage device 72 as second data 78 at step 504. Based upon the positioning of the powered wheelchair 12 and the user-worn exoskeleton 14, the master controller 16 may direct one or more movements of the powered wheelchair 12 and user-worn exoskeleton 14 at step 506 such that the user-worn exoskeleton 14 and the powered wheelchair 12 move in a manner so as to assist the user 22, from the standing position, to walk behind the powered wheelchair 12 in a system longitudinal direction (i.e., in the +x/−x directions of the coordinate axes of FIG. 1A). As such, the seat 20 may be raised, lowered (i.e., in the +z/−z directions of the coordinate axes of FIG. 1A) and/or tilted (i.e., in the +x/−x directions of the coordinate axes of FIG. 1A) into a better position for the user 22 at step 508.

The user-worn exoskeleton 14 actuates so to move or rotate the first portion 58 relative to the second portion 60 at the joint 56 of the user-worn exoskeleton 14 at step 510. Further, the powered wheelchair 12 is driven, either forwards or backwards, in the system longitudinal direction (i.e., in the +x/−x directions of the coordinate axes of FIG. 1A) at step 512. It should be appreciated that the powered wheelchair 12 may be directed in any system longitudinal and/or system lateral direction such that the user may travel in any direction. This process continues to synchronize the movements of the powered wheelchair 12 and the user-worn exoskeleton 14 at step 514. During these coordinated or synchronized movements, the first group of sensors 52 and the second group of sensors 62 may continuously provide data to the data storage device 72 such that the master controller 16 may continue to monitor the data at steps 516, 518. Further, the first group of sensors 52 may continuously provide data concerning the environment that surrounds the powered wheelchair 12 to the data storage device 72 such that the master controller 16 may continue to monitor the data at step 520. This process of data monitoring and coordinating movements may be repeated at step 506 until the second user initiated program 86 complete.

It should be appreciated that the master controller 16 monitors the first data 76 and the second data 78 to ensure that the movements between the user-worn exoskeleton 14 and the powered wheelchair 12 are coordinated or synchronized such that the user 22 may be walk with the powered wheelchair 12 without using the controller 26 of the powered wheelchair 12. As such, and as will be apparent to those skilled in the art, the master controller 16 continuously monitors the first group of sensors 52 of the powered wheelchair 12 for the location of the powered wheelchair 12 with reference to the user 22 and with reference to surrounding obstacles. Further, the seat 20 location is also monitored and the height is determined with reference to the user 22 position and the power base portion 18. The user-worn exoskeleton 14 is monitored for the movements and the position relative to the seat 20 and the powered wheelchair 12.

As such, it should be appreciated that the master controller 16 may vary the distance the powered wheelchair 12 extends away from the user 22. For example, the walking speed of the user, the height of the user, the length of the user's legs, and/or the like. may be factors into determining the distance the powered wheelchair 12 extends from the user 22. It should also be appreciated that the master controller 16 may monitor whether the user 22 maintains contact with the one or more handles 28, the speed of the steps of the user 22, the distance the powered wheelchair 12 and/or the user 22 have traveled, and/or the like. As such, the master controller 16 may alter the movements of the powered wheelchair 12 and/or the user-worn exoskeleton 14 to assist the user 22. For example, the master controller 16 may slow down the movement of the powered wheelchair 12, or tilt the seat 20 such that the at least one handle is in a better position for the user 22 to maintain a grip.

It should also be appreciated that the master controller 16 may monitor the first group of sensors 52 for data relating to the environment that surrounds the powered wheelchair 12 as discussed in step 518. For example, stairs, uneven pavement, and other such hazards. Further, the first group of sensors may transmit data related to and/or to be used with global positioning systems (GPS). As such, the first group of sensors 52 may be used to determine the current position, the position of an end point, and any hazards therebetween at step 520. As such, at step 510, the master controller 16 may direct one or more movements of the powered wheelchair 12 and the user-worn exoskeleton 14 based on the data received from the first group of sensors 52 relating to positioning and/or avoiding obstacles.

Further, it should be appreciated that the plurality of cameras 38 mounted to the powered wheelchair 12 may provide an observational view of the area in front of the powered wheelchair 12 while the user is walking behind the powered wheelchair 12. The observational control may be user 22 initiated or it may be remotely controlled by a third party. It should be appreciated that an application on the smart device, the tablet, or the like may be used to direct the powered wheelchair 12.

It should also be appreciated that the process depicted in FIG. 5B indicates that the process is only in a single direction. However, this is for illustrative purposes merely to explain a single iteration or loop of the program. It should be appreciated that the process may work in reverse order to assist the user 22. Further, it should be appreciated that the process may continuously monitor, communicate, change, and/or modify a position of the powered wheelchair 12 and/or the user-worn exoskeleton 14 as necessary. It should also be appreciated that these are merely examples of the second user initiated program 86 and that there are a plurality of movements between the powered wheelchair 12 and the user-worn exoskeleton 14 that may occur to assist in the transportation of the user 22 from one position to another position.

Figure 6A:
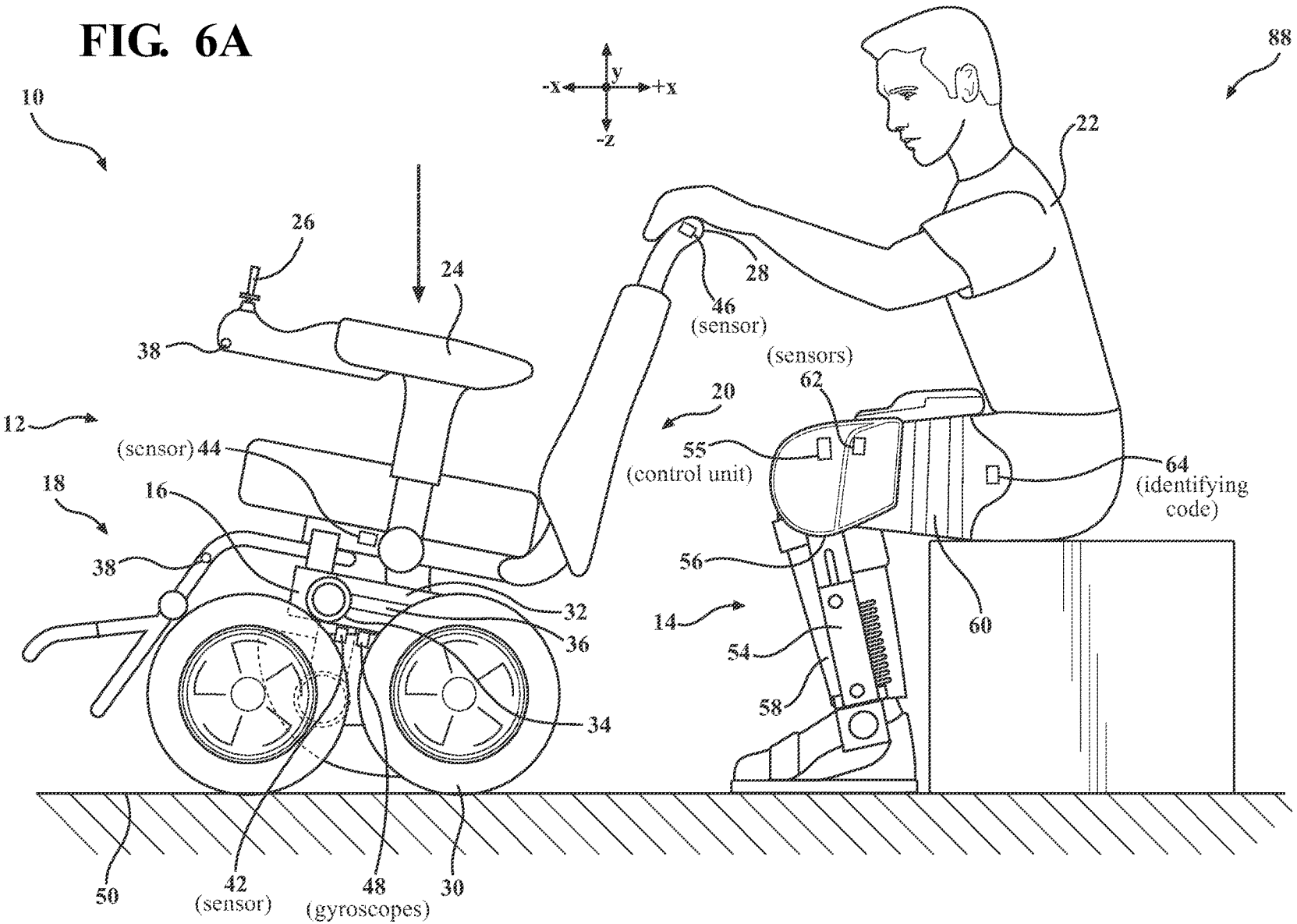
FIG. 6A schematically depicts another illustrative use of the system of FIG. 1A according to one or more embodiments shown or described herein.
Figure 6B:
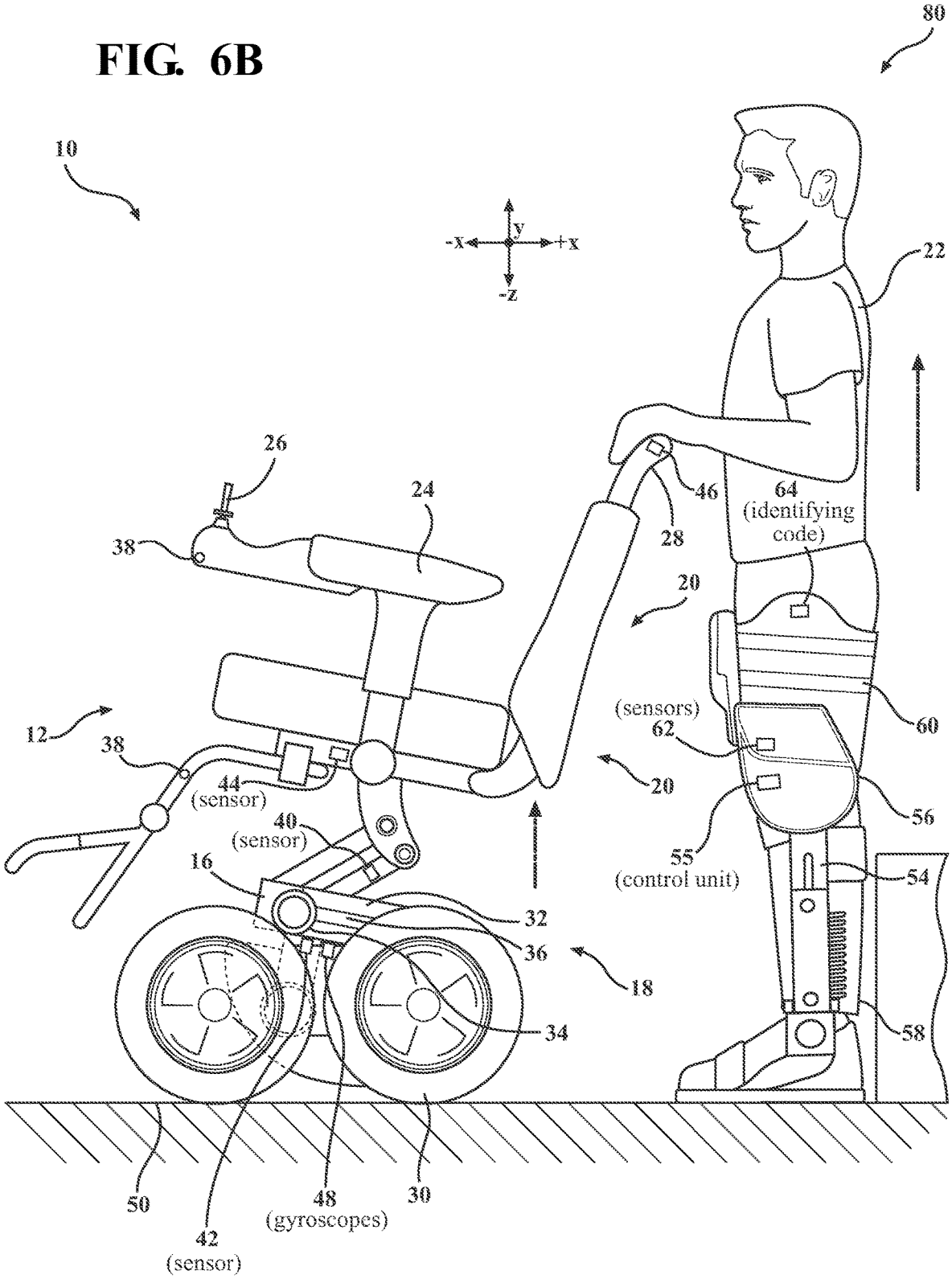
FIG. 6B schematically depicts yet another illustrative use of the system of FIG. 1A according to one or more embodiments shown or described herein.
Figure 6C:
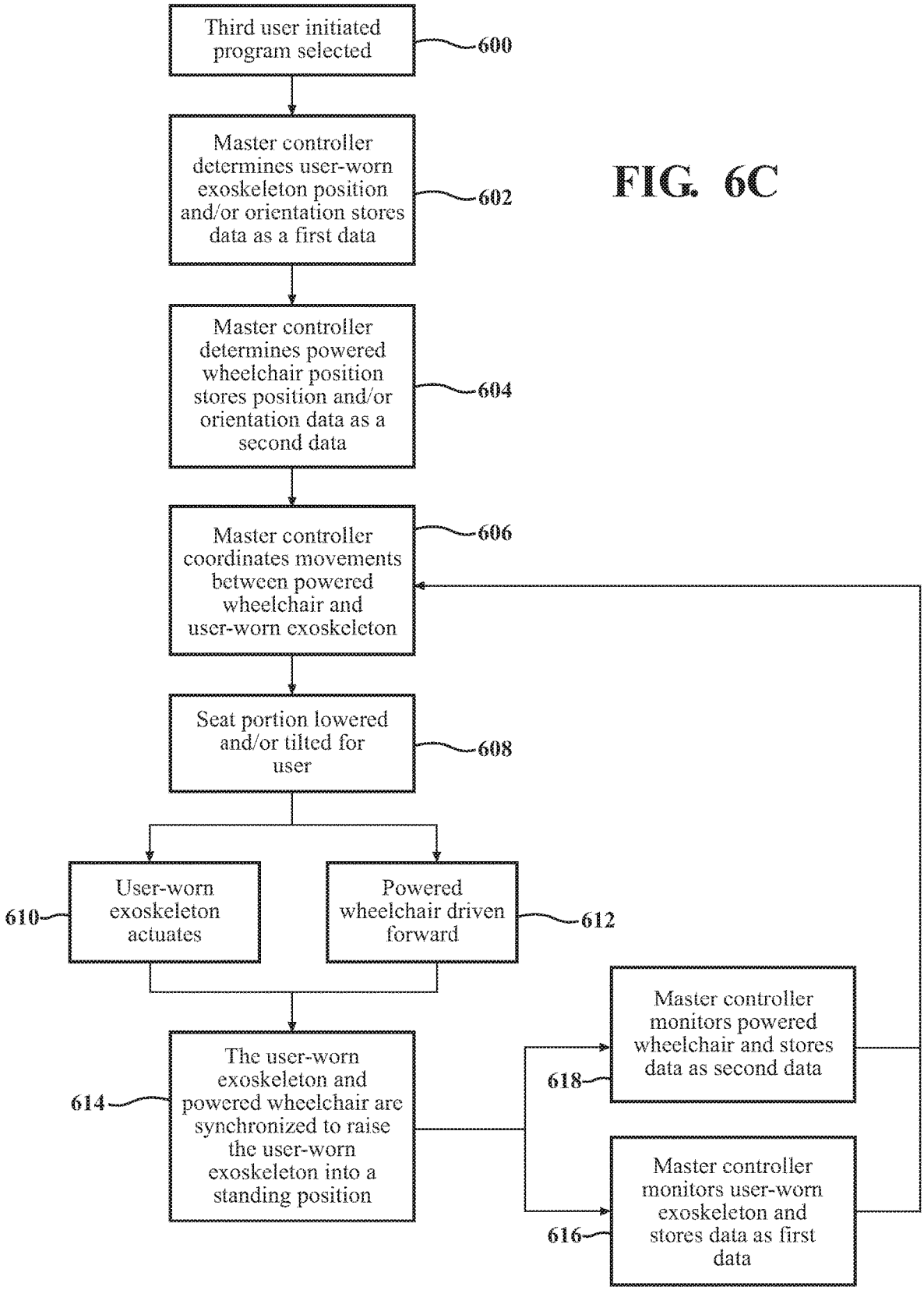
FIG. 6C depicts a flowchart of illustrative processes completed during a third user initiated program according to one or more embodiments shown or described herein.

FIGS. 6A and 6B depict an illustrative use of the system 10 of FIG. 1A. FIG. 6C is a flowchart of illustrative processes completed during a third user initiated program according to one or more embodiments shown or described herein. A third user initiated program 88 is embedded in logic module 66*a* and may be executable by the master controller 16, as discussed herein. When an input for the third user initiated program 88 is received, the master controller 16 may coordinate a plurality of synchronized movements by the powered wheelchair 12 and the user-worn exoskeleton 14 such that such that the powered wheelchair 12 raises and/or lowers the seat 20. The raising and/or lowering of the seat 20 assists the user 22 to stand and/or sit in a system vertical direction (i.e., in the +z/−z directions of the coordinate axes of FIG. 1A) from a position outside of the powered wheelchair 12. In particular, the user 22 grips the one or more handles 28 of the powered wheelchair 12. While the user 22 is in contact with the one or more handles 28, the master controller 16 coordinates the powered wheelchair 12 and the user-worn exoskeleton 14 such that the powered wheelchair 12 and the user-worn exoskeleton 14 movements are synchronized.

Once the third user initiated program 88 is selected at step 600, the master controller 16 determines the position and/or orientation of the user-worn exoskeleton 14 using the second group of sensors 62 and stores the data into the data storage device 72 as the first data 76 at step 602. The master controller 16 also determines the position of the powered wheelchair 12 using the first group of sensors 52 and stores the data into the data storage device 72 as the second data 78 at step 604. Based upon the current positioning of the powered wheelchair 12 and the user-worn exoskeleton 14, the master controller 16 may direct one or more movements of the powered wheelchair 12 and user-worn exoskeleton 14 at step 606 such that the user-worn exoskeleton 14 and the powered wheelchair 12 move in a manner so as to assist the user 22, from a sitting position to a standing position in a system vertical direction (i.e., in the +z/−z directions of the coordinate axes of FIG. 1A). As such, the seat 20 may be lowered in the system vertical direction (i.e., in the +z/−z directions of the coordinate axes of FIG. 1A) and/or tilted in the system longitudinal direction (i.e., in the +x/−x directions of the coordinate axes of FIG. 1A) into a better position for the user 22 at step 608.

The user-worn exoskeleton 14 is actuates so to move or rotate the first portion 58 relative to the second portion 60 at the joint 56 of the user-worn exoskeleton 14 at step 610. Further, the seat 20 of the powered wheelchair 12 is raised in the system vertical direction (i.e., in the +z/−z directions of the coordinate axes of FIG. 1A) at step 612. As such, the user 22 rises from the sitting position into the standing position using the one or more handles 28 of the powered wheelchair 12 for support. This process continues to synchronize the movements of the powered wheelchair 12 and the user-worn exoskeleton 14 at step 614. During these coordinated or synchronized movements, the first group of sensors 52 and the second group of sensors 62 may continuously provide data to the data storage device 72 such that the master controller 16 may continue to monitor the data at steps 616, 618. This process of data monitoring and coordinating movements may be repeated at step 606 until the second user initiated program 86 complete.

It should be appreciated that the master controller 16 monitors the first data 76 and the second data 78 to ensure that the movements between the user-worn exoskeleton 14 and the powered wheelchair 12 are coordinated or synchronized such that the user 22 may be raised and/or lowered with the powered wheelchair 12 without using the controller 26 of the powered wheelchair 12. As such, the seat 20 location is also monitored and the height is determined with reference to the user 22 position and the power base portion 18. The user-worn exoskeleton 14 is monitored for the movements and the position relative to the seat 20 and the powered wheelchair 12.

During the raising or lowering of the seat 20 by the powered wheelchair 12, the user 22 may maintain contact with the one or more handles 28. It should be appreciated that the master controller 16 may vary the distance the powered wheelchair 12 extends away from the user 22. For example, the s height of the user, the length of the user's arms, and/or the like, may all be factors into determining the distance the powered wheelchair 12 extends from the user 22. Moreover, the master controller 16 continuously monitors the height of the seat 20 and the grip of the user 22 on the one or more handles 28. It should also be appreciated that the master controller 16 may monitor whether the user 22 maintains contact with the one or more handles 28, the speed of the raise and/or the lower of the seat 20, and a plurality of other variables. As such, the master controller 16 may alter the program to assist the user 22. For example, the master controller 16 may slow down the movement of the powered wheelchair 12 or tilt the seat 20 such that the at least one handle is in a better position for the user 22 to maintain a grip. During the raising or lowering, the seat 20 may return to a neutral position (e.g., a parallel seat placement with reference to a floor surface 50) at step 614.

Once standing, the master controller 16 may further coordinate one or more user-worn exoskeleton 14 movements and/or may guide the powered wheelchair 12 into a plurality of movements while inhibiting the user-worn exoskeleton 14 so as to not allow the user 22 to lower while the powered wheelchair 12 is in motion.

It should also be appreciated that these are merely examples of the third user initiated program 88 and that there are a plurality of movements between the powered wheelchair 12 and the user-worn exoskeleton 14 that may occur to assist in the transportation of the user 22 from one position to another.

It should be appreciated that the process f of FIG. 6C indicates that the process is only in a single direction. However, this is for illustrative purposes merely to explain a single iteration or loop of the program. It should be appreciated that the process may work in reverse order to assist the user 22. Further, it should be appreciated that the process may continuously monitor, communicate, change, and/or modify a position of the powered wheelchair 12 and/or the user-worn exoskeleton 14 as necessary. It should also be appreciated that these are merely examples of the third user initiated program 88 and that there are a plurality of movements between the powered wheelchair 12 and the user-worn exoskeleton 14 to raise the user 22 from a sitting position into a standing position and/or to assist the user 22 to lower from a standing position to a sitting position while not positioned within the powered wheelchair 12.

It should also be appreciated that any movement, rotation, pivoting, and/or the like of the various components described herein (including, but not limited to the user-worn exoskeleton 14 and the powered wheelchair 12) may occur simultaneously or substantially simultaneously. However, for purposes of simplicity, the above systems have been described with respect to a single movement, rotation, pivot, and/or the like occurring at a time.

It should now be understood that the systems and methods described herein includes the powered wheelchair, the user-worn exoskeleton, and the master controller. The master controller monitors the independent movements of the powered wheelchair and the user-worn exoskeleton such that the powered wheelchair and the user-worn exoskeleton operate in a coordinated fashion that avoids conflict between the respective movements. The systems and methods described herein may also be configured such that the master controller prioritizes the movement of one particular component over another to complete an intended movement. The systems and methods described herein may also be configured such that the master controller can coordinate movements of the powered wheelchair and the user-worn exoskeleton according to one or more programmed tasks, such as, for example, assisting a user to sit within the powered wheelchair, to rise and stand behind the powered wheelchair, and/or use the powered wheelchair as a guide for walking.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A system comprising:

a wheelchair having a motor and an electronic control unit communicatively coupled to the motor for transmitting control signals to the motor;

an exoskeleton having an actuator and a control unit communicatively coupled to the actuator for transmitting control signals to the actuator, the actuator independently operable from the motor; and a master controller communicatively coupled to the ECU and the control unit, the master controller programmed to provide alternate control signals to the ECU and the control unit that override the control signals between the ECU and the motor and the control signals between the control unit and the actuator, preventing a conflict of movement between the wheelchair and the exoskeleton and directing operation of the motor and the actuator as slave devices, causing a plurality of coordinated and synchronized movements of the wheelchair and the exoskeleton, whereby the master controller is configured to override independent movement of the exoskeleton and wheelchair to avoid the conflict of movement between the exoskeleton and wheelchair.

2. The system of claim 1, wherein the plurality of coordinated and synchronized movements includes causing the wheelchair to act as a guide to a user who is walking while being assisted by the exoskeleton.

3. The system of claim 1, wherein:

the wheelchair further includes a seat portion, and the plurality of coordinated and synchronized movements includes causing the seat portion to rise in a system vertical direction to assist the user when sitting into the wheelchair.

4. The system of claim 1, wherein:

the wheelchair further includes a seat portion, and the plurality of coordinated and synchronized movements includes causing the seat portion to move to assist a user to stand from a sitting positon.

5. The system of claim 1, wherein the master controller receives an input from a user and the master controller coordinates the plurality of coordinated and synchronized movements based on the input.

6. The system of claim 5, wherein the input is provided via one or more of a voiced command, a button push, and a user interface selection.

7. The system of claim 1, further comprising a first group of sensors, that monitor a positioning of the wheelchair and a location of the wheelchair.

8. The system of claim 7, wherein the first group of sensors includes one or more location sensors.

9. The system of claim 7, further comprising a second group of sensors that monitor a positioning of the exoskeleton.

10. The system of claim 1, further comprising a plurality of cameras coupled to the wheelchair.

11. The system of claim 10, wherein the plurality of cameras provide images corresponding to an area surrounding the wheelchair.

12. The system of claim 1, wherein the exoskeleton further comprises one or more features for identifying the exoskeleton.

13. The system of claim 12, wherein image data corresponding to the one or more features is used by the master controller to identify and connect to the exoskeleton.

14. A method of controlling a powered wheelchair and a user-worn exoskeleton independently operable from the powered wheelchair, the method comprising:

receiving, by a master controller, an input from a user, the input corresponding to a particular function;

obtaining, by the master controller, first data corresponding to at least one of a positioning, a movement, or an intended movement of the user-worn exoskeleton from a control unit of the user-worn exoskeleton communicatively coupled to the master controller;

obtaining, by the master controller, second data corresponding to at least one of a positioning, a movement, or an intended movement of the powered wheelchair from an electronic control unit of the powered wheelchair communicatively coupled to the master controller; and providing, by the master controller, alternate control signals to the ECU and the control unit that override the first data and the second data the master controller overriding independent movement of the user-worn exoskeleton and the powered wheelchair to avoid a conflict of movement between the powered wheelchair and the user-worn exoskeleton and directing operation of the powered wheelchair and the user-worn exoskeleton to each act as a slave device to the master controller to coordinate to move the powered wheelchair and the user-worn exoskeleton in a plurality of coordinated and synchronized movements based on the alternate control signals, the first data and the second data.

15. The method of claim 14, wherein the master controller causing the powered wheelchair and the user-worn exoskeleton to move in the plurality of coordinated and synchronized movements includes causing the powered wheelchair to act as a guide to a user who is walking while being assisted by the user-worn exoskeleton.

16. The method of claim 14, wherein the master controller causing the powered wheelchair and the user-worn exoskeleton to move in the plurality of coordinated and synchronized movements includes causing a seat portion of the powered wheelchair to raise.

17. The method of claim 14, wherein the input from the user is provided via one or more of a voice command, a button push, and a user interface selection.

18. A system comprising:

a wheelchair having at least one motor communicatively coupled to an electronic control unit (ECU) for transmitting control signals to the motor;

an exoskeleton having at least one actuator communicatively coupled to a control unit for transmitting control signals to the actuator, the at least one motor is independently operable from the at least one actuator; and a master controller communicatively coupled to the ECU and the control unit, the master controller programmed to provide alternate control signals to the ECU and the control unit that override the control signals between the ECU and the motor and the control signals between the control unit and the actuator preventing a potential conflict or an actual conflict of the movements between the at least one motor and the at least one actuator and directing operation of the at least one motor and the at least one actuator as slave devices so to permit either the at least one motor or the at least one actuator to move between a first position and a second position, whereby the master controller is configured to override independent movement of the exoskeleton and wheelchair to avoid the potential conflict or the actual conflict of movements between the at least one motor and the at least one actuator.

19. The system of claim 18, wherein the master controller coordinates a plurality of coordinated and synchronized movements between the at least one motor and the at least one actuator.

20. The system of claim 19, wherein the master controller receives an input from a user and the master controller coordinates the plurality of coordinated and synchronized movements between the at least one motor and the at least one actuator based on the input.

* * * * *